US009842714B2

(12) United States Patent
Reder et al.

(10) Patent No.: US 9,842,714 B2
(45) Date of Patent: Dec. 12, 2017

(54) DETECTING CURRENT LEAKAGE IN A HEATING ELEMENT

(71) Applicant: General Electric Company, Schenectady, NY (US)

(72) Inventors: Andrew Leroy Reder, Louisville, KY (US); Davide Jonathan Leone, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 379 days.

(21) Appl. No.: 14/715,765

(22) Filed: May 19, 2015

(65) Prior Publication Data

US 2016/0338569 A1 Nov. 24, 2016

(51) Int. Cl.

| | |
|---|---|
| ***A47L 15/46*** | (2006.01) |
| ***H01H 47/00*** | (2006.01) |
| ***H05B 1/02*** | (2006.01) |
| ***A47L 15/00*** | (2006.01) |
| ***A47L 15/42*** | (2006.01) |

(52) U.S. Cl.

CPC ..... *H01H 47/002* (2013.01); *A47L 15/0049* (2013.01); *A47L 15/4285* (2013.01); *H05B 1/0252* (2013.01); *A47L 2401/30* (2013.01); *A47L 2501/32* (2013.01); *H01H 47/004* (2013.01)

(58) Field of Classification Search

CPC .. A47L 15/0049; A47L 15/4285; A47L 15/46; A47L 2401/30; A47L 2501/32; H05B 1/0252; H01H 47/002; H01H 47/004

USPC ..... 361/42

See application file for complete search history.

(56) References Cited

U.S. PATENT DOCUMENTS

| | | | | |
|---|---|---|---|---|
| 4,219,857 | A * | 8/1980 | Haraldsson | H02H 5/04 219/509 |
| 4,484,243 | A | 11/1984 | Herbst et al. | |
| 6,822,344 | B2 | 11/2004 | Muldoon | |

* cited by examiner

*Primary Examiner* — Scott Bauer
*Assistant Examiner* — Kevin J Comber
(74) *Attorney, Agent, or Firm* — Dority & Manning, P.A.

(57) ABSTRACT

Systems and methods of detecting current leakage in a heating element are provided. An alternating current signal can be applied to the heating element. The heating element can have an associated line relay and an associated neutral relay coupled to a line terminal of the heating element and a neutral terminal of the heating element, respectively. A control system can be configured to control a sequence of operations of the line and neutral relays such that the magnitude of a leakage current flowing through the heating element to ground is increased. Such increased magnitude can facilitate detection of the leakage current. The detected leakage current can be compared with a leakage threshold. The control system can cease the operation of the heating element if the leakage current is greater than the leakage threshold.

20 Claims, 5 Drawing Sheets

DETECTING CURRENT LEAKAGE IN A HEATING ELEMENT

FIELD OF THE INVENTION

The present disclosure relates generally to dishwashing appliances, and more particularly to protecting heating elements of dishwashing appliances.

BACKGROUND OF THE INVENTION

Modern dishwashing appliances (e.g. dishwashers) typically include a tub defining a wash chamber where, for instance, detergent, water, and heat can be applied in order to clean food and/or other materials from dishes and other articles being washed. Various cycles may be included as part of the overall cleaning process. For example, a typical, user-selected cleaning option may include a wash cycle and rinse cycle (referred to collectively as a wet cycle), as well as a drying cycle. A pre-wash cycle may also be included as part of the wet cycle, and may be automatic or an option for particularly soiled dishes.

It is common to provide dishwashers with rod-type, resistive heating elements in order to supply heat within the wash chamber during one or more of the dishwasher cycles (e.g. during the drying cycle). Generally, these heating elements include an electric resistance-type wire that is encased in a magnesium oxide-filled, metallic sheath.

Such dishwasher heating elements can be exposed to harsh environments that may cause premature failure of the heating elements. For instance, chlorine attack, calcium buildup and/or power surge events can cause premature failure of a dishwasher heating element. Such premature heating element failure may cause a violent ignition due at least in part to high current arcing or sheath rupture. Heating element failure generally follows a measurable increase in current leakage. Ground fault detection can be used to detect current leakage and to prevent such failure. To enable ground fault detection, a means must be provided for electrical dispersion from the heating element to earth ground. However, coupling a heating element sheath to ground can place the heating element at risk of failure due to lightning strikes. Additionally, it can be difficult to detect current leakage at various fault points on the heating element due at least in part to the voltage drop across the heating element.

Thus, it is desirable to provide a system for detecting current leakage with a high level of sensitivity that provides protection from high voltage surges caused by lightning strikes.

BRIEF DESCRIPTION OF THE INVENTION

Aspects and advantages of embodiments of the present disclosure will be set forth in part in the following description, or may be learned from the description, or may be learned through practice of the embodiments.

One example aspect of the present disclosure is directed to a heating element protection system for a dishwashing appliance. The protection system includes a resistive heating element having a metallic sheath that is coupled to ground. The heating element includes a line side terminal coupled to a line conductor and a neutral side terminal coupled to a neutral conductor. The protection system further includes a first relay coupled to the line conductor. The protection system further includes a second relay coupled to the neutral conductor. The protection system further includes a control system in operative communication with the first and second relays. The control system is configured to monitor for a leakage current flowing from the heating element to ground by controlling a sequence of operations of the first relay and the second relay such that a magnitude of the leakage current is increased.

Another example aspect of the present disclosure is directed to a method of monitoring current leakage in a heating element having a sheath coupled to ground. The heating element is further coupled to a line conductor having a line relay and a neutral conductor having a neutral relay. The method includes applying an alternating current signal to the heating element. The method further includes configuring the line relay and the neutral relay in a first state, wherein during the first state, the line relay is closed and the neutral relay is open. The method further includes identifying a current flowing through the heating element to ground. Configuring the line relay and neutral relay in the first state provides an increase in the magnitude of a leakage current flowing through the heating element to ground.

Yet another example aspect of the present disclosure is directed to a dishwashing appliance. The dishwashing appliance includes a tub defining a wash chamber. The dishwashing appliance further includes a rack assembly disposed within the wash chamber of the tub. The rack assembly is configured for supporting articles for washing within the wash chamber of the tub. The dishwashing appliance further includes a resistive heating element comprising a resistance-type wire and a metallic sheath coupled to ground. The dishwashing appliance further includes a control system in operative communication with the heating element. The control system is configured to detect a leakage current flowing from the heating element to ground by controlling a sequence of operations of the heating element such that a magnitude of the leakage current is increased.

Variations and modifications can be made to these example embodiments of the present disclosure.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION OF THE INVENTION

Figure 1:
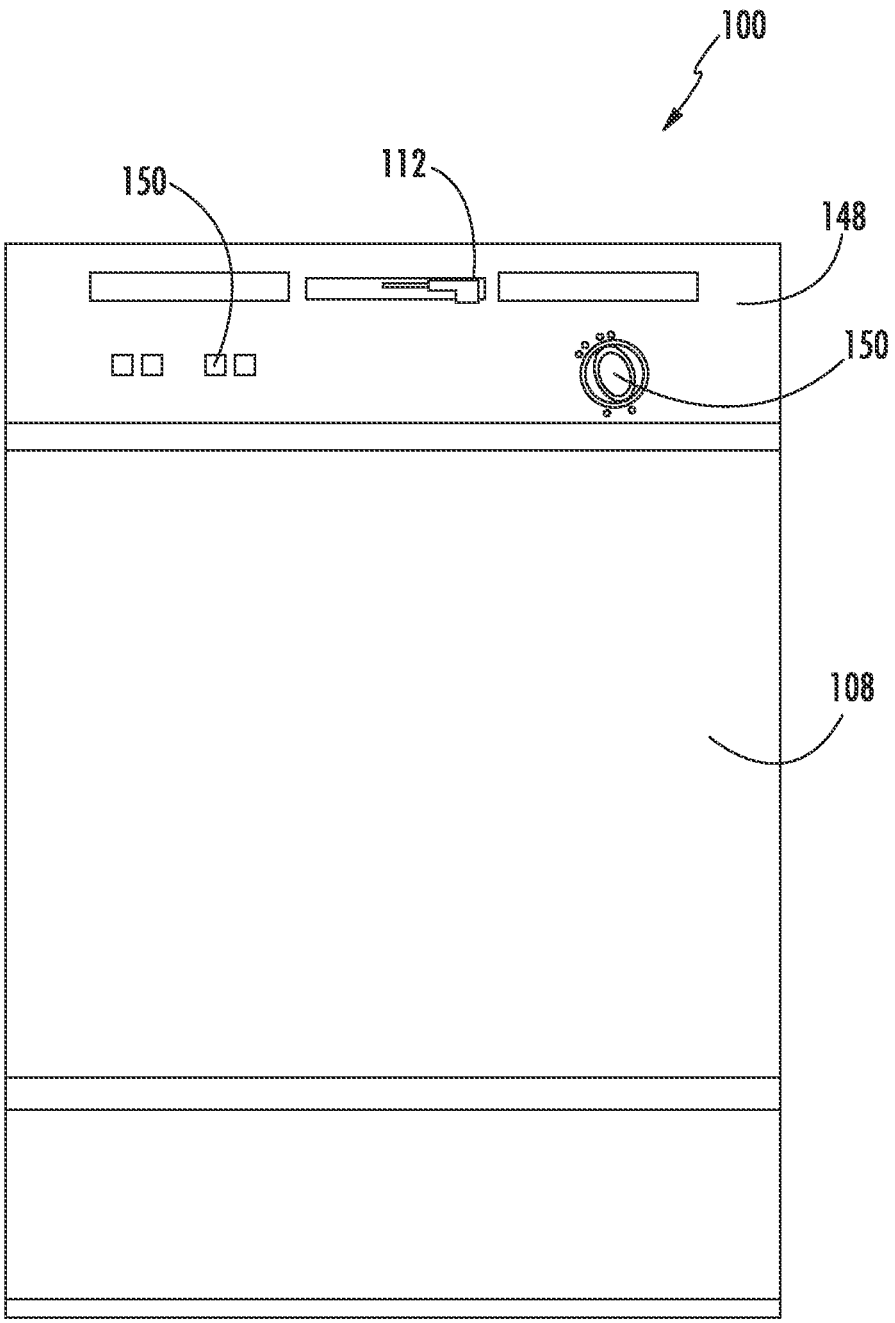
FIG. 1 depicts a front view of an example dishwashing appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Example aspects of the present disclosure are directed to monitoring current leakage in a dishwashing appliance (e.g. dishwasher) heating element. As used herein, current leakage (also referred to as leakage current) can be defined as current that flows through a protective ground conductor to ground. As used herein, "ground" refers to an electrical ground or other reference point or common. In particular, a dishwasher can include a resistive heating element. The heating element can include a resistance-type wire encased in a magnesium oxide-filled, metallic sheath. The sheath can be coupled to ground or other reference potential via a ground conductor. The heating element can include a line side terminal and a neutral side terminal. A line conductor can be coupled between the line side terminal and a positive terminal of an alternating current power supply. A neutral conductor can be coupled between the neutral side terminal and a negative terminal of the power supply. The line conductor can be further coupled to a line relay, and the neutral conductor can be further coupled to a neutral relay. In example embodiments, when the line and neutral relays are closed, a current can flow through the resistance wire of the heating element to the neutral conductor, causing the heating element to increase in temperature. The line relay and the neutral relay can be used to break the circuit at the line conductor and the neutral conductor respectively.

In example embodiments, a sequence of operations of the line relay and the neutral relay can be controlled to monitor leakage current from the heating element to ground. In particular, during an energize cycle of the heating element, both the line relay and the neutral relay can be closed to provide power to the heating element. The neutral relay can then be configured to open for a predetermined time period. For instance, the neutral relay can be configured to open for a time period in a range of about 20 milliseconds to about 70 milliseconds. As used herein, the term "about," when used in reference to a numerical value, is intended to refer to within 30% of the numerical value. It will be appreciated that the relay can be configured to open for various other suitable time periods, such as any suitable time period sufficient to detect a leakage current.

With the neutral relay open and the line relay closed, current will not flow through the resistance wire of the heating element to the neutral conductor, but the resistance wire will have a high potential relative to ground. This configuration can cause an increase in the magnitude of any leakage current flowing through resistance wire to ground. The increased leakage current can be more easily detected. In example embodiments, if a leakage current is detected having a magnitude above a leakage threshold, both the line relay and the neutral relay can be configured to open to break the circuit at the line conductor and the neutral conductor and to cease operation of the dishwashing appliance.

Figure 2:
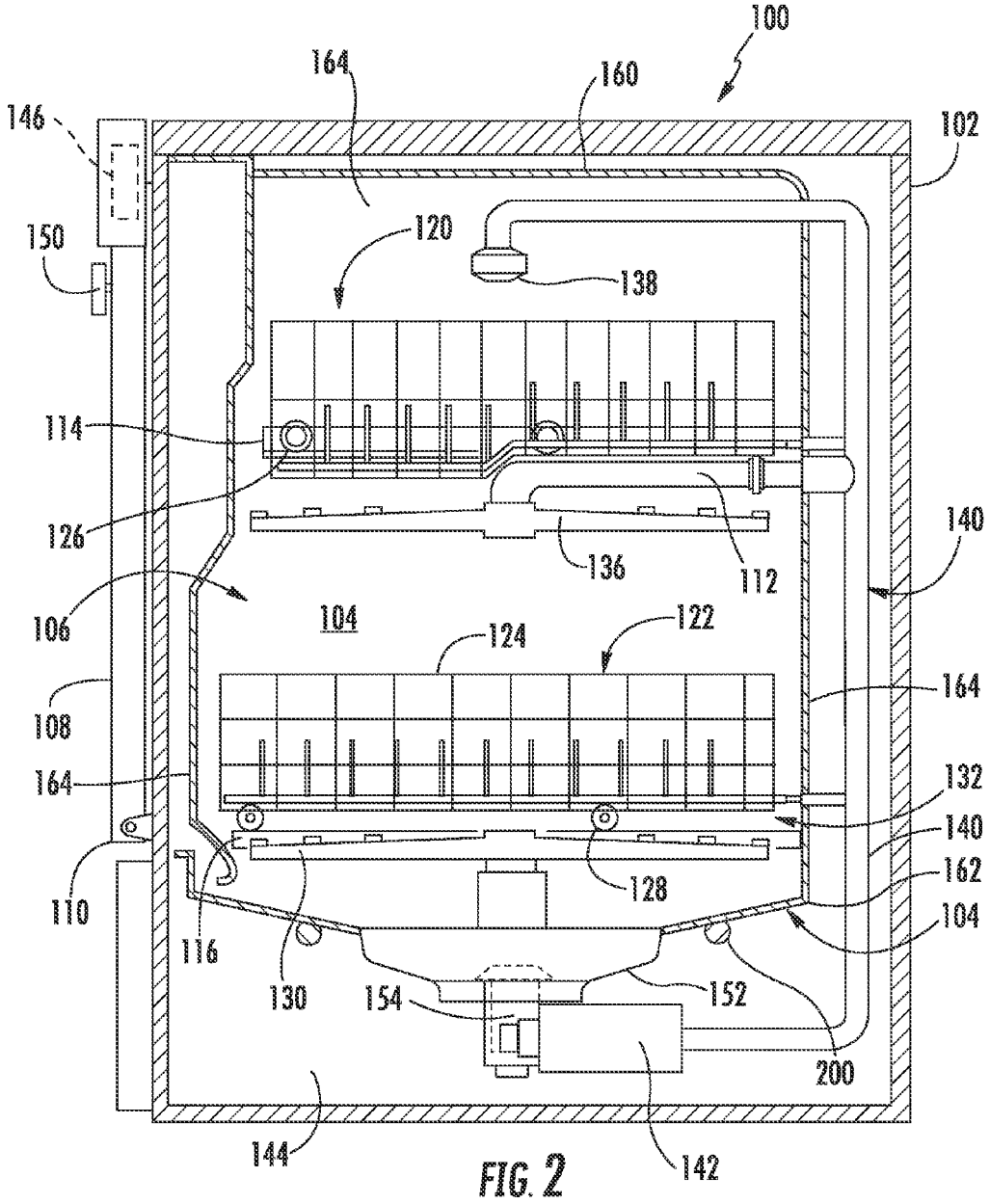
FIG. 2 depicts a cross-sectional view of the example dishwashing appliance according to example embodiments of the present disclosure.

FIGS. 1 and 2 depict one embodiment of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. As shown in FIG. 1, a latch 112 may be used to lock and unlock the door 108 for access to the chamber 106.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. It should be appreciated that the tub 104 may generally be formed from any suitable material. However, in several embodiments, the tub 104 may be formed from a ferritic material, such as stainless steel.

As particularly shown in FIG. 2, upper and lower guide rails 114, 116 may be mounted on opposing side walls 164 of the tub 104 and may be configured to accommodate roller-equipped rack assemblies 120 and 122 configured for supporting articles for washing within the wash chamber of the tub. Each of the rack assemblies 120, 122 may be fabricated into lattice structures including a plurality of elongated members 124 (for clarity of illustration, not all elongated members making up assemblies 120 and 122 are shown in FIG. 2). Additionally, each rack 120, 122 may be adapted for movement between an extended loading position (not shown) in which the rack is substantially positioned outside the wash chamber 106, and a refracted position (shown in FIGS. 1 and 2) in which the rack is located inside the wash chamber 106. This may be facilitated by rollers 126 and 128, for example, mounted onto racks 120 and 122, respectively. As is generally understood, a silverware basket (not shown) may be removably attached to rack assembly 122 for placement of silverware, utensils, and the like, that are otherwise too small to be accommodated by the racks 120, 122.

Additionally, the dishwashing appliance 100 may also include a lower spray-arm assembly 130 that is configured to be rotatably mounted within a lower region 132 of the wash chamber 106 directly above the bottom wall 162 of the tub 104 so as to rotate in relatively close proximity to the rack assembly 122. As shown in FIG. 2, a mid-level spray-arm assembly 136 may be located in an upper region of the wash chamber 106, such as by being located in close proximity to the upper rack 120. Moreover, an upper spray assembly 138 may be located above the upper rack 120.

As is generally understood, the lower and mid-level spray-arm assemblies 130, 136 and the upper spray assembly 138 may generally form part of a fluid circulation assembly 140 for circulating water and dishwasher fluid within the tub 104. As shown in FIG. 2, the fluid circulation assembly 140 may also include a pump 142 located in a machinery compartment 144 located below the bottom wall 162 of the tub 104, as is generally recognized in the art. Additionally, each spray-arm assembly 130, 136 may include an arrangement of discharge ports or orifices for directing washing liquid onto dishes or other articles located in rack assemblies 120 and 122, which may provide a rotational force by virtue of washing fluid flowing through the discharge ports. The resultant rotation of the lower spray-arm assembly 130 provides coverage of dishes and other dishwasher contents with a washing spray.

The dishwashing appliance 100 may be further equipped with a controller 146 configured to regulate operation of the dishwasher 100. The controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 146 may be positioned in a variety of locations throughout dishwashing appliance 100. In the illustrated embodiment, the controller 146 is located within a control panel area 148 of the door 108, as shown in FIG. 1. In such an embodiment, input/output ("I/O") signals may be routed between the control system and various operational components of dishwashing appliance 100 along wiring harnesses that may be routed through the bottom 110 of the door 108.

Typically, the controller 146 includes a user interface panel/controls 150 through which a user may select various operational features and modes and monitor progress of the dishwasher 100. In one embodiment, the user interface 150 may represent a general purpose I/O ("GPIO") device or functional block. Additionally, the user interface 150 may include input components, such as one or more of a variety of electrical, mechanical or electro-mechanical input devices including rotary dials, push buttons, and touch pads. The user interface 150 may also include a display component, such as a digital or analog display device designed to provide operational feedback to a user. As is generally understood, the user interface 150 may be in communication with the controller 146 via one or more signal lines or shared communication busses.

Additionally, as shown in FIG. 2, a portion of the bottom wall 162 of the tub 104 may be configured as a tub sump portion 152 that accommodates a filter assembly 154 configured to remove particulates from the fluid being recirculated through the wash chamber 106 during operation of the dishwashing appliance 100. For example, fluid collected within the tub sump portion 152 of the bottom wall 162 may be passed through the filter assembly 154 and then diverted back to the pump 142 for return to the wash chamber 106 by way of the fluid recirculation assembly 140.

Moreover, as shown in FIG. 2, the dishwashing appliance 100 may also include a heating element 200 provided in operative association with the tub 104 for providing heat energy during a wash, rinse, and/or drying cycle to, for example, heat the fluid introduced into wash chamber 106 and/or to assist with drying articles. As will be described in greater detail below, heating element 200 may be configured (e.g. using controller 146) to operate in a manner that facilitates the monitoring of current leakage from heating element 200 to ground.

It should be appreciated that the present subject matter is not limited to any particular configuration, model, or style of dishwashing appliance. The exemplary embodiment depicted in FIGS. 1 and 2 is simply provided for illustrative purposes only. For example, different locations may be provided for the user interface 150, different configurations may be provided for the racks 120, 122, and other differences may be applied as well.

Figure 3:
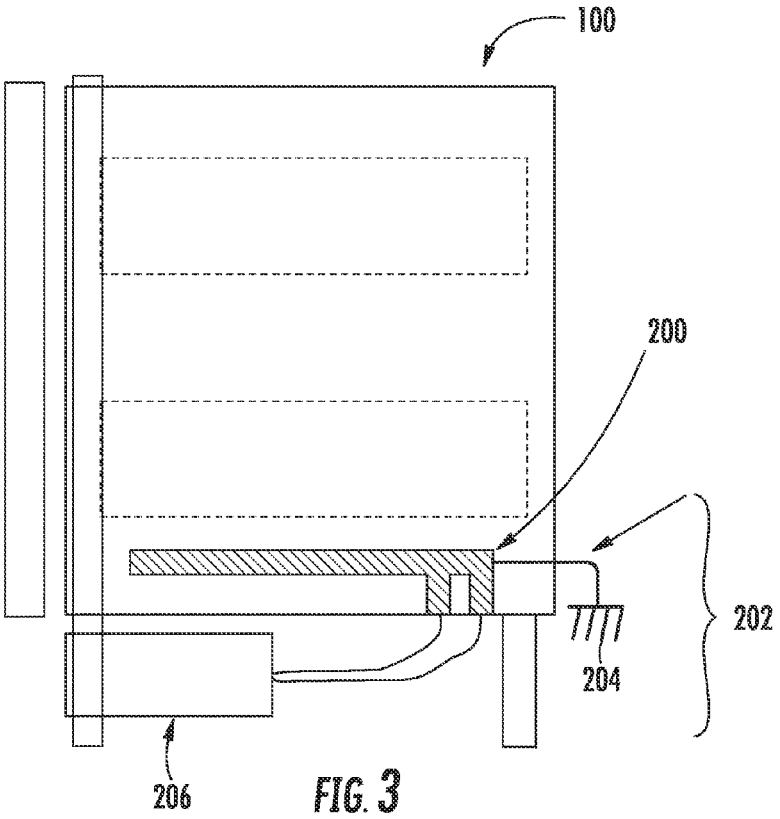
FIG. 3 depicts an example heating element protection system implemented in the dishwashing appliance according to example embodiments of the present disclosure.

FIG. 3 depicts an example heating element protection system 202 implemented in a dishwashing appliance 100 according to example embodiments of the present disclosure. Heating element protection system 202 can include a resistive heating element 200. As indicated above, heating element 200 can include a resistance-type wire encased in a magnesium oxide-filled, metallic sheath. It will be appreciated that other suitable materials may be used to fill the sheath, such as for instance, various suitable ceramics. The sheath is coupled to earth ground 204, or other reference potential. In particular, heating element 200 can be a resistive heating element that converts electricity into heat by providing resistance to the applied signal as the signal flows through the resistance wire of the heating element. Heating element 200 can further be coupled to a control system 206. Control system 206 can include, for instance, controller 146, and/or various other suitable circuit configurations for detecting current leakage.

Control system 206 can be configured to control the operation of heating element 200. In example embodiments, control system 206 can be configured to control a sequence of operations associated with heating element 200 to monitor and detect current leakage, for instance by configuring various relays and/or switches coupled to heating element 200 to open and close in accordance with example embodiments of the present disclosure. As will be described below, control system 206 can further be configured to protect heating element 200 from overvoltage surges caused by, for instance, lightning strikes.

Figure 4:
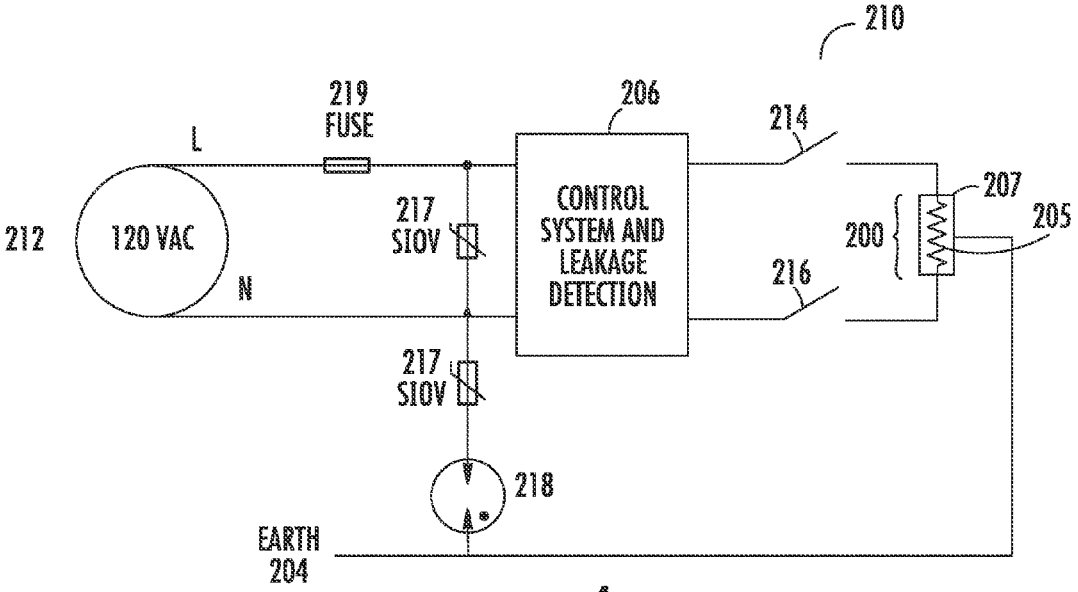
FIG. 4 depicts an example circuit implementation of a heating element protection system according to example embodiments of the present disclosure.

FIG. 4 depicts an example circuit configuration 210 of a heating element protection system. For instance, circuit configuration 210 can correspond to heating element protection system 202. Circuit configuration 210 includes an AC power supply 212 and a heating element 200 having a resistance-type wire 205 encased in a metallic sheath 207 coupled to earth ground 204. Although FIG. 4 depicts a 120 volt power supply, it will be appreciated that various other suitable power supplies can be used. Circuit configuration 210 further includes a control system 206 coupled between power supply 212 and heating element 200. As indicated above, control system 206 can be configured to control the operation of heating element 200. In particular, control system 206 can control the operation of heating element 200 by sending command signals to line relay 214 and neutral relay 216 to cause the relays to open and close.

In this manner, control system 206 can control a sequence of operations of line relay 214 and neutral relay 216. The sequence of operations can be controlled to facilitate detection of a leakage current present in circuit configuration 210. In particular, a leakage current can be detected by comparing current at the line conductor with current at the neutral conductor. If the two currents are equal, it can be assumed that there is no leakage current flowing from heating element 200 to earth ground 204. A leakage current can be identified when the line conductor current is different than the neutral conductor current. In particular, the leakage current can be equal, or nearly equal, to the difference between the line conductor current and the neutral conductor current.

In example embodiments, circuit configuration 210 can further include metal oxide varistors 217. Varistors 217 can be used in conjunction with gas discharge tube 218 to suppress overvoltage surges in circuit configuration 210. Because the sheath of heating element 200 is coupled to earth ground, heating element 200 can be susceptible to failure due to lightning strikes. Varistors 217 and gas discharge tube 218 can suppress overvoltage surges due to such lightning strikes. Circuit configuration 210 can further include fuse 219. Fuse 219 can "blow" causing a break in the circuit if the current flowing through fuse 219 exceeds a fuse threshold. Accordingly, fuse 219 can further protect circuit configuration 219 from excessive current.

Figure 5:
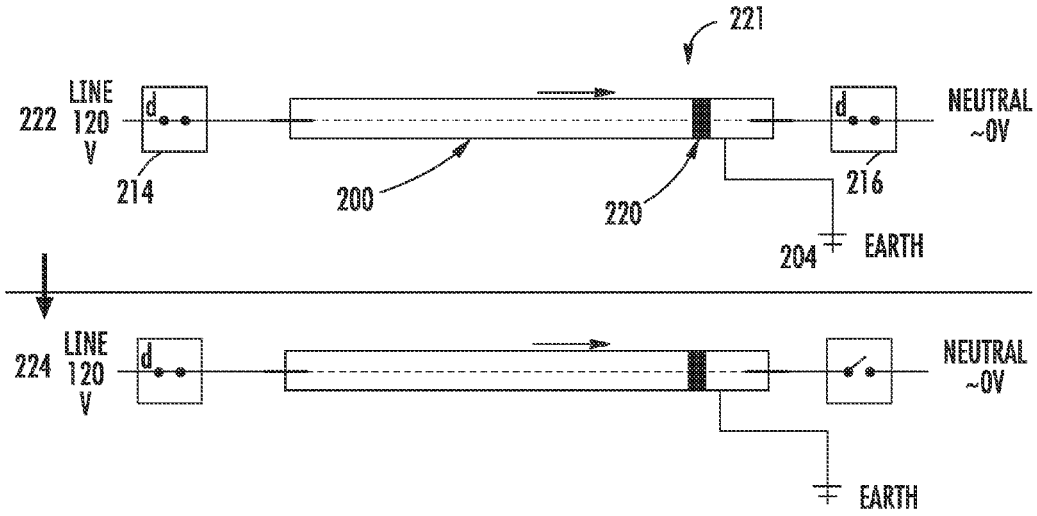
FIG. 5 depicts an example sequence of operations for detecting current leakage according to example embodiments of the present disclosure.

FIG. 5 depicts an example sequence of operations 221 of heating element 200 according to example embodiments of the present disclosure. FIG. 5 depicts a relevant portion of circuit configuration 210, including heating element 200, line relay 214, neutral relay 216, and earth ground 204. FIG. 5 further depicts a ground fault 220 located proximate the neutral conductor. As depicted in FIG. 5, the sequence of operations 221 can include state 222 and state 224. During state 222, both line relay 214 and neutral relay 216 can be closed, and current can flow through the resistance wire of heating element 200, which can cause an increased temperature of heating element 200. When configured in state 222, leakage current caused by ground fault 220 can be difficult to detect due to the voltage drop across the resistance wire of heating element 200.

To facilitate improved detection of the leakage current, line relay 214 and neutral relay 216 can subsequently be configured in state 224. During state 224, line relay 214 can be closed and neutral relay 216 can be opened. As described above, when configured in state 224, no current flows through the resistance wire of heating element 200 to the neutral conductor, but heating element has a potential of 120 volts relative to ground 204. If there is a ground fault present in heating element 200 (e.g. ground fault 220), the magnitude of the leakage current flowing from the resistance wire of heating element 200 to ground 204 will be increased (compared to the leakage current present in state 222). Such increased leakage current can be more easily detected. In particular, such leakage current can be detected regardless of the position of the ground fault on heating element 200.

In example embodiments, line relay 214 and neutral relay 216 can be configured in state 224 for a predetermined period of time. For instance, the predetermined period of time can be in a range of about 20 milliseconds to about 60 milliseconds. It will be appreciated that other suitable periods of time can be used, such as any period of time in which a current leakage can be detected. Subsequent to the predetermined period of time, line relay 214 and neutral relay 216 can be configured in a different state, for instance, in accordance with a previously scheduled cycle, or as otherwise desired by a user.

It will be appreciated that the teachings of the present disclosure can be implemented at various times during the operation of a dishwasher. For instance, such teachings can be implemented at the beginning of (or immediately prior to) an energize cycle of heating element 200, and/or at the end of (or immediately after) the energize cycle. As another example, such teachings can be implemented upon the opening of the dishwasher door at any point during the operation of the dishwasher. It will be further appreciated that the teachings of the present disclosure may be implemented at various other suitable times and/or in response to various other suitable triggers.

As indicated above, once a leakage current is detected, the leakage current can be compared to a leakage threshold. For instance, the leakage threshold can be in the range of about 15 milliamps to about 30 milliamps. The leakage threshold can be comprise various other suitable current amounts, such as for instance, an amount of current in the range of about 10 milliamps to about 100 milliamps. If the detected leakage current is greater than the leakage threshold, the operation of the heating element can be ceased. In example embodiments, the operation of the heating element can be ceased by configuring line relay 214 and neutral relay 216 to open. In alternative embodiments, the operation of heating element 200 can be ceased through a software operation implemented by a controller associated with heating element 200, such as controller 146 of FIG. 2.

Figure 6:
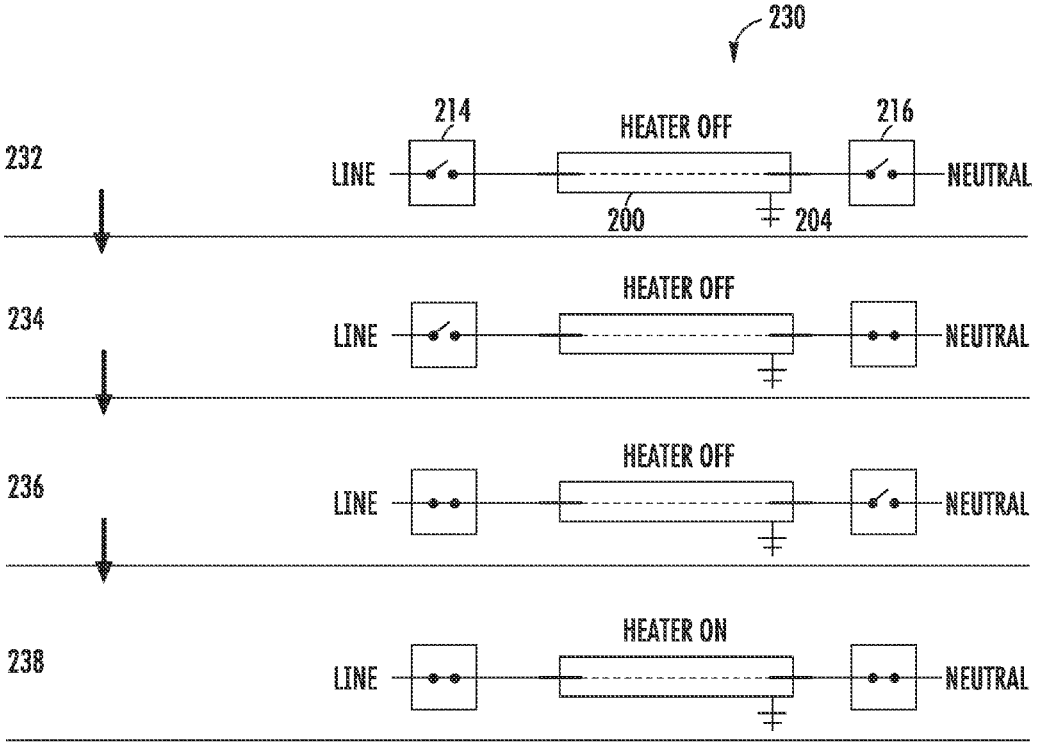
FIG. 6 depicts an example sequence of operations for detecting current leakage in a heating element according to example embodiments of the present disclosure.

According to alternative embodiments, various other suitable sequences can be used to facilitate detection of current leakage. For instance, FIG. 6 depicts an example sequence of operations according to an example embodiment of the present disclosure. FIG. 6, like FIG. 5, depicts a relevant portion of circuit configuration 210, including heating element 200, line relay 214, break relay 216, and earth ground 204. In particular, FIG. 6 depicts a sequence of operations 230 for detecting current leakage at the beginning of an energize cycle of heating element 200. As shown, in state 232 both line relay 214 and neutral relay 216 are open. Accordingly, no current flows through heating element 200. To initiate monitoring for current leakage, line relay 214 and neutral relay 216 can then be configured in state 234. During state 234, line relay 214 is open and neutral relay 216 is closed. Configuring the relays 214 and 216 in state 234 can be useful, for instance, if the power supply (e.g. power supply 212) reverses polarity. In such scenario, the neutral conductor becomes analogous to the line conductor and vice versa.

Line relay 214 and neutral relay 216 can then be configured in state 236. During state 236, line relay 214 is closed and neutral relay 216 is open. State 236 is analogous to state 224 in FIG. 5. As in FIG. 5 above, the relays 214 and 216 can be configured in state 234 and state 236 each for a predetermined period of time. For instance, the predetermined period of time can be in the range of about 20 milliseconds to about 60 milliseconds. After the predetermined period of time corresponding to state 236, the energize cycle can begin by configuring line relay 214 and neutral relay 216 in state 238. During state 238, both relays are closed and current can flow from the line conductor to the neutral conductor through heating element 200.

Figure 7:
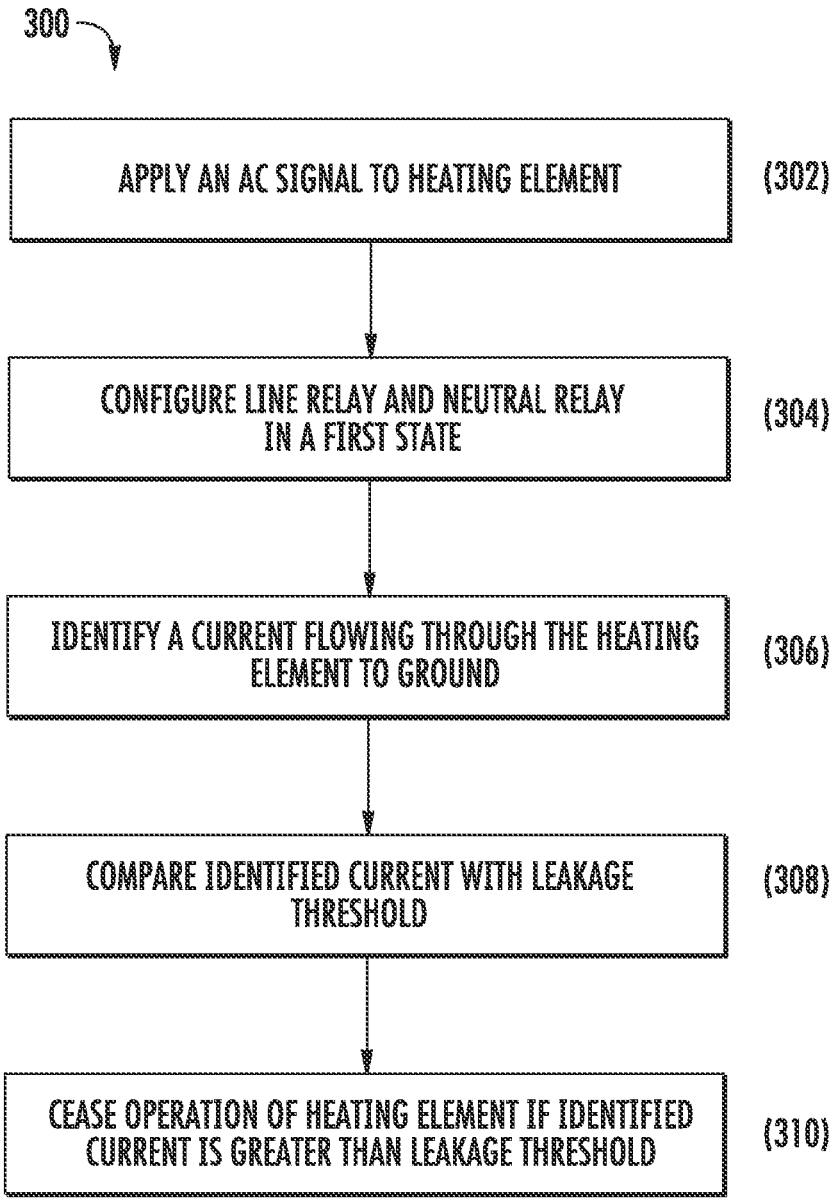
FIG. 7 depicts a flow diagram of an example method of monitoring current leakage in a heating element.

FIG. 7 depicts a flow diagram of an example method (300) of detecting current leakage according to example embodiments of the present disclosure. Method (300) can be implemented using any suitable system, including, for example, heating element protection system 202 of FIG. 3. In addition, FIG. 7 depicts steps performed in a particular order for purposes of illustration and discussion. Those of ordinary skill in the art, using the disclosures provided herein, will understand that the various steps of any of the methods disclosed herein can be omitted, adapted, and/or rearranged in various ways.

At (302), method (300) can include applying an AC signal to a heating element. At (304), method (300) can include configuring a line relay coupled to the heating element and a neutral relay coupled to the heating element in a first state. In particular, during the first state, the line relay can be closed and the neutral relay can be opened. Such configuration can facilitate detection of leakage current by increasing a magnitude of the leakage current (relative to the magnitude of a leakage current when the line relay and the neutral relay are both closed). It will be appreciated that the first state can include various other suitable relay arrangements, such as for instance, an arrangement wherein the line relay is open and the neutral relay is closed.

At (306), method (300) can include identifying a current flowing through the heating element resistance wire to ground (e.g. leakage current). As indicated above, the leakage current can be identified by determining the difference between the current flowing through the line conductor and the current flowing through the neutral conductor.

At (308), method (300) can include comparing the identified leakage current with a leakage threshold. The leakage threshold can be a value in the range of about 15 milliamps to about 30 milliamps. At (310), method (300) can include ceasing the operation of the heating element if the identified current is greater than the leakage threshold. As indicated above, the operation of the heating element can be ceased by configuring both the line relay and the neutral relay to open. In alternative embodiments, the operation of the heating element may be ceased using a software operation implemented by a controller associated with the heating element.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A heating element protection system for a dishwashing appliance, the protection system comprising:

a resistive heating element having a metallic sheath that is coupled to ground, the heating element comprising a line side terminal coupled to a line conductor and a neutral side terminal coupled to a neutral conductor;

a first relay coupled to the line conductor;

a second relay coupled to the neutral conductor; and a control system in operative communication with the first and second relays, the control system configured to monitor for a leakage current flowing from the heating element to ground by controlling a sequence of operations of the first relay and the second relay such that a magnitude of the leakage current is increased.

2. The heating element protection system of claim 1, wherein the control system is further configured to detect the increased leakage current, and cease operation of the dishwashing appliance if the magnitude of the increased leakage current is greater than a leakage threshold.

3. The heating element protection system of claim 1, wherein the sequence of operations comprises the first and second relays being configured in a first state, wherein during the first state the first relay is closed and the second relay is open.

4. The heating element protection system of claim 3, wherein the sequence of operations further comprises the first and second relays being configured in a second state, wherein during the second state the first relay is open and the second relay is closed.

5. The heating element protection system of claim 3, wherein the first and second relays are configured in the first state for a range of about 20 milliseconds to about 70 milliseconds.

6. The heating element protection system of claim 4, wherein the first and second relays are configured in the second state for a range of about 20 milliseconds to about 70 milliseconds.

7. The heating element protection system of claim 2, wherein the control system is configured to cease operation of the dishwashing appliance by opening the first relay and the second relay.

8. The heating element protection system of claim 1, further comprising at least one metal oxide varistor and at least one gas discharge tube configured to suppress voltage surges.

9. The heating element protection system of claim 2, wherein the leakage threshold is in the range of about 15 milliamps to about 30 milliamps.

10. The heating element protection system of claim 1, wherein the control system is configured to monitor for the leakage current at the beginning of an energize cycle of the heating element.

11. The heating element protection system of claim 10, wherein the control system is further configured to monitor for the leakage current responsive to the opening of a door of the dishwashing appliance.

12. The heating element protection system of claim 2, wherein the leakage current is detected at least in part by comparing current on the line conductor with current on the neutral conductor.

13. A method of monitoring current leakage in a heating element having a sheath coupled to ground, the heating element being further coupled to a line conductor having a line relay and a neutral conductor having a neutral relay, the method comprising:

applying an alternating current signal to the heating element;

configuring the line relay and the neutral relay in a first state, wherein during the first state, the line relay is closed and the neutral relay is open; and identifying a current flowing through the heating element to ground;

wherein configuring the line and neutral relays in the first state provides an increase in the magnitude of a leakage current flowing through the heating element to ground.

14. The method of claim 13, further comprising configuring the line relay and the neutral relay in a second state, wherein the line relay is open and the neutral relay is closed.

15. The method of claim 13, wherein the line relay and the neutral relay are configured in the second state for a predetermined period of time.

16. The method of claim 13, further comprising comparing the identified current to a leakage threshold and ceasing operation of the heating element if the identified current is greater than the leakage threshold.

17. A dishwashing appliance comprising:

a tub defining a wash chamber;

a rack assembly disposed within the wash chamber of the tub, the rack assembly configured for supporting articles for washing within the wash chamber of the tub;

a resistive heating element comprising a resistance-type wire encased in a metallic sheath coupled to ground; and a control system in operative communication with the heating element, the control system configured to detect a leakage current flowing from the heating element to ground by controlling a sequence of operations of the heating element such that a magnitude of the leakage current is increased.

18. The dishwashing appliance of claim 17, wherein the sequence of operations comprises first and second relays being configured in a first state, wherein during the first state the first relay is closed and the second relay is open.

19. The dishwashing appliance of claim 18, wherein the sequence of operations further comprises the first and second relays being configured in a second state, wherein during the second state the first relay is open and the second relay is closed.

20. The dishwashing appliance of claim 17, wherein the leakage current is detected at least in part by determining the difference between a current on a line conductor coupled to a line terminal of the heating element and a current on a neutral conductor coupled to a neutral terminal of the heating element.

* * * * *